US008119940B2

(12) United States Patent
Kerr

(10) Patent No.: US 8,119,940 B2
(45) Date of Patent: Feb. 21, 2012

(54) CONTACT BLOCK

(75) Inventor: David Howard Kerr, Burscough Lancashire (GB)

(73) Assignee: Rockwell Automation Limited, Maldon Essex (GB)

( * ) Notice: Subject to any disclaimer, the term of this patent is extended or adjusted under 35 U.S.C. 154(b) by 637 days.

(21) Appl. No.: 12/039,346

(22) Filed: Feb. 28, 2008

(65) Prior Publication Data

US 2008/0257696 A1 Oct. 23, 2008

(30) Foreign Application Priority Data

Apr. 21, 2007 (GB) ..... 0707730.8

(51) Int. Cl.
*H01H 15/00* (2006.01)

(52) U.S. Cl. ..... 200/16 A; 200/243

(58) Field of Classification Search ..... 200/16 A, 200/243

See application file for complete search history.

(56) References Cited

U.S. PATENT DOCUMENTS 3,514,554 A * 5/1970 Boysen ..... 200/16 R
4,064,381 A * 12/1977 Mullen et al. ..... 200/16 A
4,355,216 A * 10/1982 Kane et al. ..... 200/16 A
5,172,805 A * 12/1992 Gumb ..... 200/341
5,278,369 A 1/1994 Spanio
5,283,406 A * 2/1994 Olsen ..... 200/243
6,072,128 A * 6/2000 Ansorge et al. ..... 200/5 R
6,307,167 B1 10/2001 Kajio et al.

FOREIGN PATENT DOCUMENTS

EP 1 770 735 A1 4/2007

* cited by examiner

*Primary Examiner* — Elvin G Enad
*Assistant Examiner* — Lisa Klaus
(74) *Attorney, Agent, or Firm* — Boyle Fredrickson, S.C.; William R. Walbrun; John M. Miller

(57) ABSTRACT

The present invention includes a contact block for a safety switch that has a support structure and a pair of electrical contacts that are fixed in position on the support structure. The contact block includes a contact block plunger provided with a bridging contact. The bridging contact extends through the contact block plunger, from one side to another, and protrudes from the sides of the contact block plunger. The contact block plunger is moveable in-between the fixed pair of electrical contacts to move the bridging contacts into and out of contact with the fixed pair of electrical contacts. A contact block guide extends along the support structure and between the pair of fixed electrical contacts and cooperates with the contact block plunger such that the contact block plunger is restricted to movement along the contact block guide.

22 Claims, 5 Drawing Sheets

CONTACT BLOCK

CROSS-REFERENCE TO RELATED APPLICATIONS

This application claims priority to Great Britain Patent Application No. 07077308, filed on Apr. 21, 2007, titled "Contact Block" and the disclosure of which is expressly incorporated herein.

BACKGROUND

The present invention relates to contact blocks, and in particular to contact blocks for safety switches.

Safety switches are devices which are operable to selectively allow or prevent the supply of power to, for example, electrically powered kinetic machinery. A safety switch may be located at the door of an enclosure. In the enclosure may be located kinetic machinery. If the door to the enclosure is closed, an actuator may be brought into engagement with the safety switch to close a switch mechanism which allows the safety switch to conduct electricity, thereby allowing electrical power to be supplied to machinery within the enclosure. Conversely, if the door to the enclosure is opened, the actuator is disengaged from the safety switch, and this opens the switch mechanism and causes the safety switch to change from a conducting to a non-conducting state. Thus, when the actuator has been disengaged from a safety switch, electrical power is not supplied to the machinery within the enclosure.

Whether the safety switch is in a conducting or non-conducting state is determined by the configuration of electrical contacts located within the safety switch. These contacts are located within a contact block. A prior art contact block 1 is shown in FIG. 1*a*.

FIG. 1*b* illustrates certain parts of the contact block 1 of FIG. 1*a*. FIG. 1*c* shows these parts in cross section, taken across the plane P1 and in the direction of the arrow A1. FIGS. 1*b* and 1*c* are referred to in combination. Four pairs of fixed electrical contacts 2 are provided and fixed in position relative to the contact block 1. Extending along the contact block 1, and in-between the pairs of fixed contacts 2, is a contact block plunger 3. The contact block plunger 3 is provided with four bridging contacts 4 which extend through the body of the contact block plunger 3 and protrude from the sides of the contact block plunger. The bridging contacts 4 are moveable, within limits imposed by the body of the contact block plunger 3, back and forth along the length of the contact block plunger 3. The contact block plunger 3 is moveable in the contact block to bring the bridging contacts 4 into contact with specific pairs of fixed contacts 2. When the bridging contacts 4 are brought into contact with the pairs of fixed contacts 2, a current may flow between the pairs of fixed contacts 2.

The contact block plunger 3 is biased to a default position by a first helical spring 5. The first helical spring 5 runs alongside and is substantially parallel to the main body of the contact plunger 3, and is fixed to and exerts a pulling or pushing force against a lip 3*a* of the contact plunger 3. The lip 3*a* extends in a direction substantially perpendicular to the length of the contact block plunger 3. In a similar manner, each bridging contact 4 is biased to a default position by one of a number of second helical springs 6 which are located in and extend along the contact block plunger 3.

In use, the contact block plunger 3 may be moved in any appropriate manner. For example, another element (not shown) may push against an end of the contact block plunger 3 to move the bridging contacts 4 into and out of electrical connection with the fixed contacts 2. In many safety switches, a cam arrangement is provided, the cam arrangement being rotatable by engagement with an actuator (e.g. a key). A cam follower (sometimes referred to as a cam plunger) is provided which is biased against a surface of the cam arrangement. First, when the cam arrangement is rotated, the position of the cam plunger may be changed. The cam plunger's position may be changed to push against or pull the contact block plunger 3 to move the bridging contacts 4 into and out of electrical connection with the fixed contacts 2.

Although the prior art contact block 1 shown in FIGS. 1*a* to 1*c* is used in large numbers and in a variety of different types of safety switches, it has a number of disadvantages. Firstly, it is possible that the contact block plunger 3 can move towards and away from the fixed contacts 2. This may cause the bridging contacts 4 to be misaligned with the fixed contacts 2 which may mean that it is difficult or impossible to reliably make and maintain an electrical connection between the fixed pairs of electrical contacts 2. Similarly, the contact block plunger 3 may move up or down (in relation to the orientation of the contact block as shown in the Figures), which again may cause misalignment with the fixed contacts 2. When the first helical spring 5 is compressed, it may 'snake', such that the first helical spring 5 when compressed does not extend in a linear fashion, but in an undulating or wave like fashion. If the first helical 5 spring does this, its biasing force will not act solely in an axial direction (i.e. parallel to the length of the contact block plunger 3) but also in other directions. This may cause the contact block plunger 3 to be pushed into parts of the contact block 1 (for example, the fixed pairs of contacts 2) or to be pushed away from parts of the contact block 1. In either case, this could again cause misalignment between the bridging contacts 4 or the contact block plunger 3 and the fixed contacts 2. If pushed into parts of the contact block 1, the contact block plunger 3 could also suffer from increased wear due to increased friction between itself and the parts against which it is pushed. The fixed pairs of contacts 2, for example, may become loose if consistently and/or repeatedly pressed against by the contact block plunger 3.

In some safety switches, the contact block 1 is connected to a printed circuit board (not shown). Electrical connection is made to the printed circuit board by a terminal block or terminal block connector (not shown) which is attached to the printed circuit board. However, if wires connected to the terminal block are pulled, the terminal block may be pulled off the printed circuit board. Furthermore, the printed circuit board may become damaged and require replacement.

It is therefore an object of the present invention to provide a contact block and contact block plunger which obviate or mitigate at least one of the disadvantages of the prior art, whether identified herein or elsewhere.

SUMMARY OF THE INVENTION

According to a first aspect of the present invention there is provided a contact block for a safety switch, the contact block comprising: a support structure; a fixed pair of electrical contacts that are fixed in position on the support structure; and a contact block plunger provided with a bridging contact. The bridging contact extends through the contact block plunger, from one side to another, and protrudes from the sides of the contact block plunger. The contact block plunger is moveable in-between the fixed pair of electrical contacts to move the bridging contacts into and out of contact with the fixed pair of electrical contacts. The contact block further comprises a contact block guide that extends along the support structure and between the pair of fixed electrical contacts. The contact block plunger is co-operable with the contact block guide such that the contact block plunger is restricted to movement along the contact block guide.

Preferably, the contact block guide is spaced apart from the supporting structure and the contact block plunger is located between the guide and the support structure. Preferably, the support structure is provided with an upstanding lip that extends in a direction substantially perpendicularly away from the planar support structure. The contact block guide is attached to and extends away from the upstanding lip. Alternatively, the contact block may comprise a casing for encasing internal workings of the contact block wherein the contact block guide is provided on an inner surface of the casing.

Preferably, the contact block guide is a guide rail. Preferably, the guide rail is substantially cylindrical. Preferably, the contact block plunger is provided with a channel co-operable with the contact block guide.

Alternatively, the contact block guide maybe a channel. Preferably, the contact block plunger is provided with an elongate protrusion running along the length of the contact block plunger and co-operable with the channel.

Preferably, the contact block comprises a second contact block guide. Preferably, the second contact block guide is located on the support structure. Alternatively, the second contact block guide is located in a recess provided in the support structure.

Preferably, the second contact block guide is a second guide rail. Preferably, the second guide rail is substantially cylindrical. Preferably, the contact block plunger is provided with a channel co-operable with the second guide rail.

Alternatively, the second contact block guide is a channel. Preferably, the contact block plunger is provided with an elongate protrusion running along the length of the contact block plunger and which is co-operable with the channel.

Preferably, a biasing element is provided on an end of the contact block plunger, and extending away from the contact block plunger. Preferably, the biasing element is a spring.

According to a second aspect of the present invention there is provided a contact block for a safety switch wherein the contact block includes a support structure and a pair of electrical contacts that are fixed in position on the support structure. The contact block further comprises a guide extending along the support structure and between the pair of fixed electrical contacts. The guide is co-operable with a contact block plunger such that the contact block plunger is restricted to movement along the guide.

According to a third aspect of the present invention there is provided a contact block plunger for a contact block. The contact block plunger includes a bridging contact that extends through the contact block plunger, from one side to another, and protrudes from the sides of the contact block plunger. The contact block plunger further comprises a guide extending along the length of the contact block plunger. The contact block plunger is co-operable with a guide of a contact block such that the contact block plunger is restricted to movement along the guide of the contact block.

According to a fourth aspect of the present invention there is provided a contact block for a safety switch, the contact block comprising: a circuit board; a fixed pair of electrical contacts fixed in position and connected to the circuit board; and a support structure which extends across the circuit board such that the fixed pair of electrical contacts extend from the circuit board and through the support structure.

Preferably, the contact block further comprises a terminal block or terminal block connector that is formed integrally with the support structure. Preferably, the terminal block or terminal block connector is in electrical connection with the circuit board.

Preferably, the circuit board is substantially planar. Preferably, the support structure comprises a substantially planar region attached to the substantially planar circuit board. Preferably, the fixed pair of electrical contacts extends through the substantially planar region of the support structure.

The contact block maybe provided with a contact block plunger. Preferably, the contact block plunger is provided with a bridging contact, the bridging contact extending through the contact block plunger, from one side to another, and protruding from the sides of the contact block plunger. Preferably, the contact block plunger is moveable in-between the fixed pair of electrical contacts to move the bridging contacts into and out of contact with the fixed pair of electrical contacts.

BRIEF DESCRIPTION OF THE DRAWINGS

Embodiments of the present invention will now be described, by way of example only, with reference to the accompanying Figures in which like features have been given the same reference numerals, and in which.

DETAILED DESCRIPTION

Figure 1A:
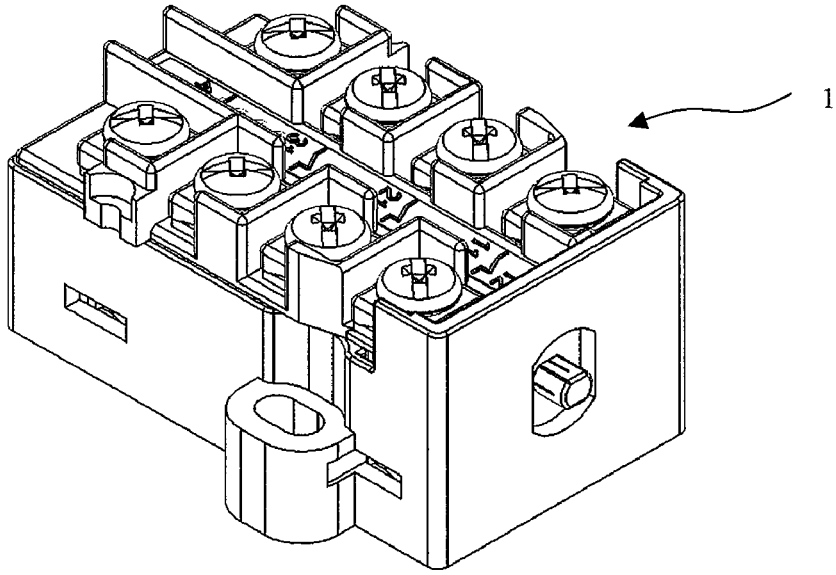
FIG.1a PRIOR ART
FIGS. 1*a* to 1*c* depict a prior art contact block.
Figure 1B:
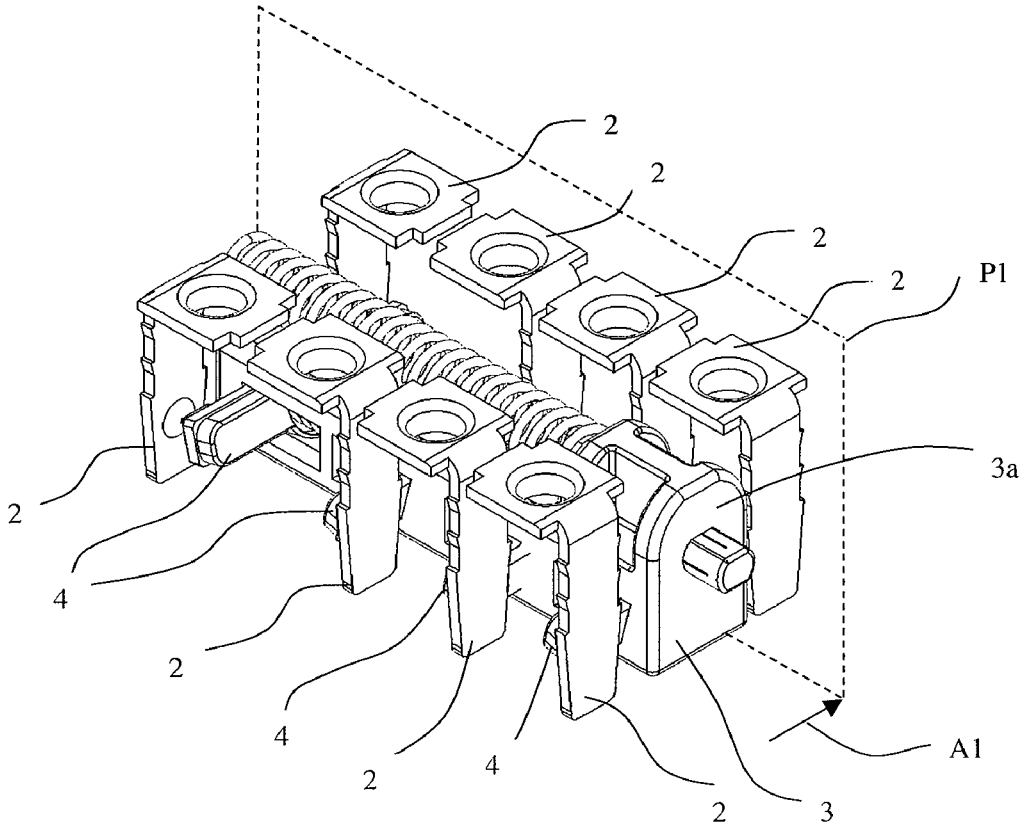
FIG.1b PRIOR ART
Figure 1C:
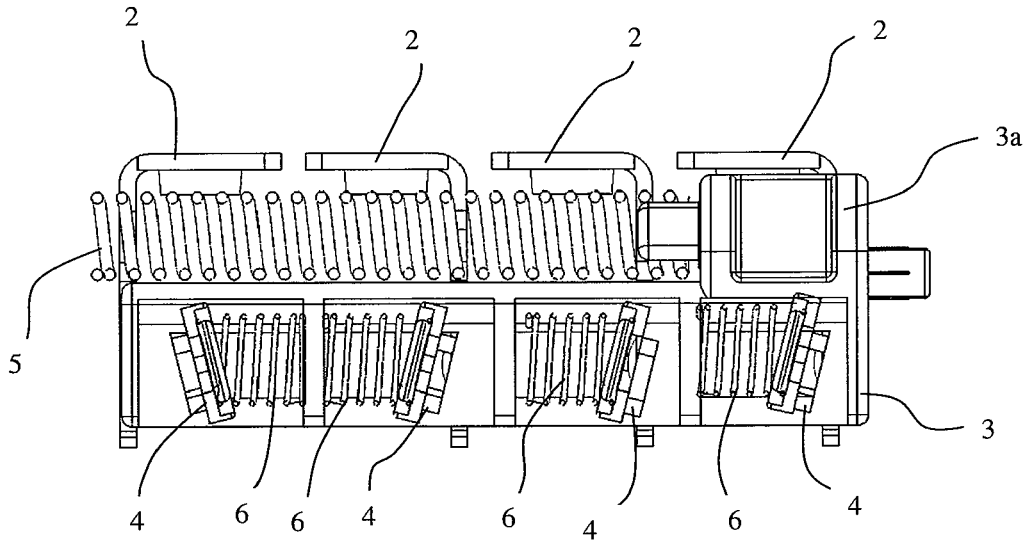
FIG.1c PRIOR ART
Figure 2A:
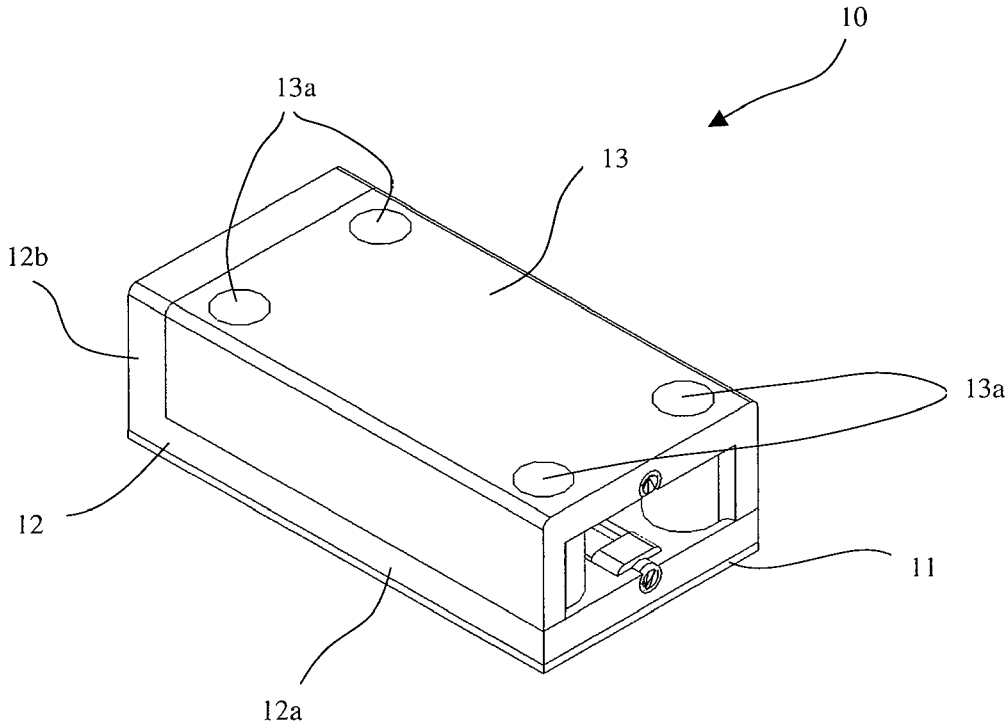
FIGS. 2*a* and 2*b* depict a contact block according to an embodiment of the present invention.

FIG. 2*a* depicts a perspective view of a contact block 10 according to an embodiment of the present invention. The contact block 10 is provided with a printed circuit board 11 to which electrical connections are made. It will be appreciated that any circuit board may be used in place of the printed circuit board 11. Mounted on the printed circuit board 11 is a support structure 12. The support structure 12 is provided with a planar region 12*a* which is in contact with the printed circuit board 11, and also an upstanding lip 12*b* which extends perpendicularly away from the planar region 12*a*. The contact block 10 is also provided with a casing 13 which encases internal workings (not shown in this Figure) of the contact block 10. The casing 13 is provided with four holes 13*a*, though which fixings (e.g. screws, bolts or the like) may be passed to secure the contact block 10 to another structure (for example, a safety switch).

Figure 2B:
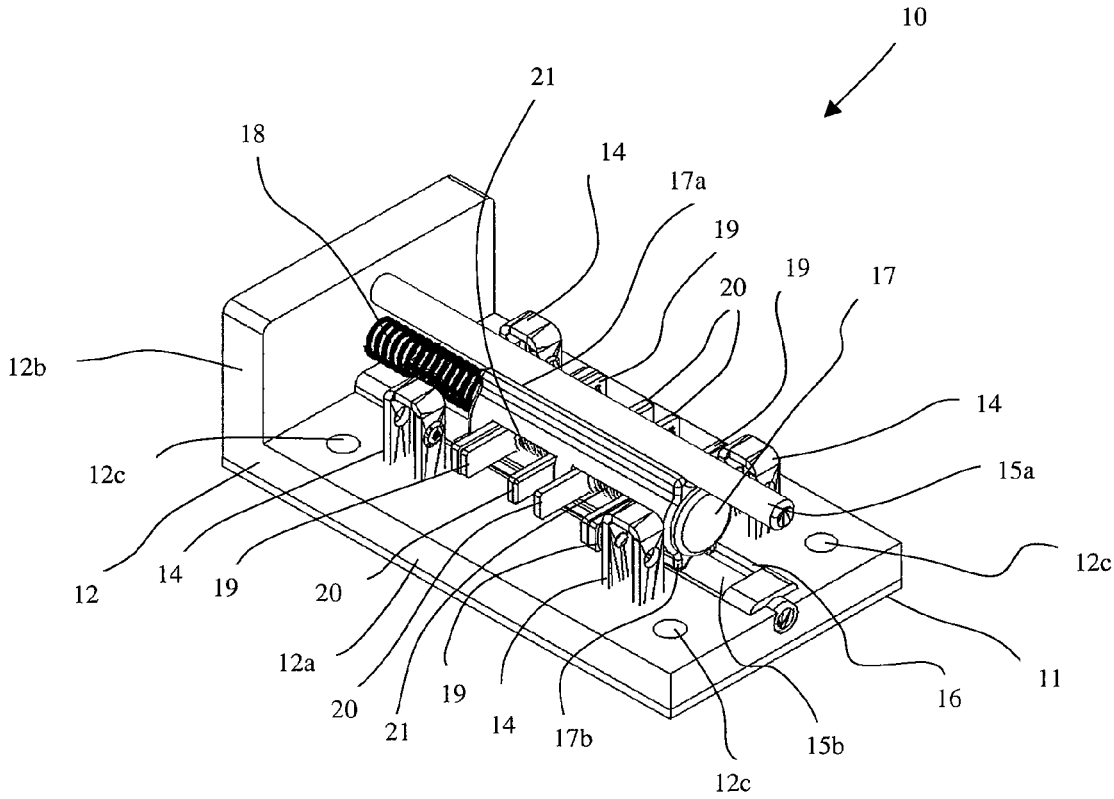

FIG. 2*b* shows the contact block 10 with the casing 13 removed, such that the internal workings of the contact block 10 may be seen. Two pairs of fixed contacts 14 are shown connected to the printed circuit board 11 and extending through the planar region 12*a* of the supporting structure 12. Located between the pairs of fixed contacts 14 are two guide rails: an upper guide rail 15*a* and a lower guide rail 15*b*. The upper guide rail 15*a* and the lower guide rail 15*b* extend parallel to one another along the length of the supporting structure 12. The upper guide rail 15*a* is attached to and extends from the upstanding lip 12*b* of the supporting structure 12 and is therefore spaced apart from the planar region, or in other words the main body of the supporting structure. The lower guide rail 15*b* is located in a recess 16 provided along the length of the planar region 12*a* of the supporting structure 12. Located between the upper guide rail 15*a* and the lower guide rail 15*b* is a substantially cylindrical contact block plunger 17. The contact block plunger 17 is provided with an upper channel 17*a* shaped to cooperate with the upper guide rail 15*a*, and a lower channel 17*b* which is shaped to cooperate with the lower guide rail 15*b*. The contact block plunger 17 is moveable along the length of the supporting structure 12, the movement of the contact block plunger 17 being guided by the upper guide rail 15*a* and lower guide rail 15*b*. The contact block plunger 17 is biased to a default position by a first helical spring 18 which is attached to an end of the contact block plunger 17.

The contact block plunger 17 is provided with two bridging contacts 19 which extend through the body of the contact block plunger 17 and which protrude from either side of the contact block plunger 17. By moving the contact block plunger 17 the bridging contacts 19 may be brought into or out of contact with the pairs of fixed contacts 14. When the bridging contacts 19 are in contact with the pairs of fixed contacts 14, a current may flow between each of the pairs of the contacts 14 (i.e. the contact plunger is in a conducting state). The bridging contacts 19 are moveable along the length of the contact block plunger 17, although the extent to this movement is restricted by stops 20. The bridging contacts 19 are biased to a default position by second helical springs 21.

The planar region 12*a* of the support structure 12 is provided with four holes 12*c* which are in alignment with the holes 13*a* of the casing 13. As mentioned above in relation to the casing 13, the holes 12*c* in the support structure 12 allow fixings to be passed through the holes 12*c*, which may facilitate the attachment of the contact block 10 to another structure (for example, a safety switch).

The upper guide rail 15*a* is described as being attached to and extending from the upstanding lip 12*b* of the supporting structure 12. Instead, the upper guide rail 15*a* may be provided on (e.g. attached to or integral to) an inner surface of the casing 13 shown in FIG. 2*a*. This alternative arrangement may be preferable, since the upper guide rail will then be supported along its length, as opposed to only being supported at one of its ends. FIG. 2*b* still graphically represents this alternative arrangement, albeit with the casing 13 shown in FIG. 2*a* removed for clarity.

Figure 3A:
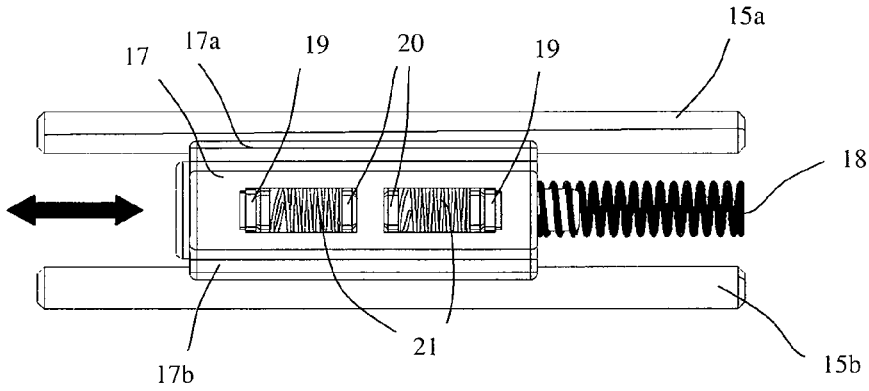
FIGS. 3*a* and 3*b* depict operating principles of the contact block as shown in FIGS. 2*a* and 2*b;*
Figure 3B:
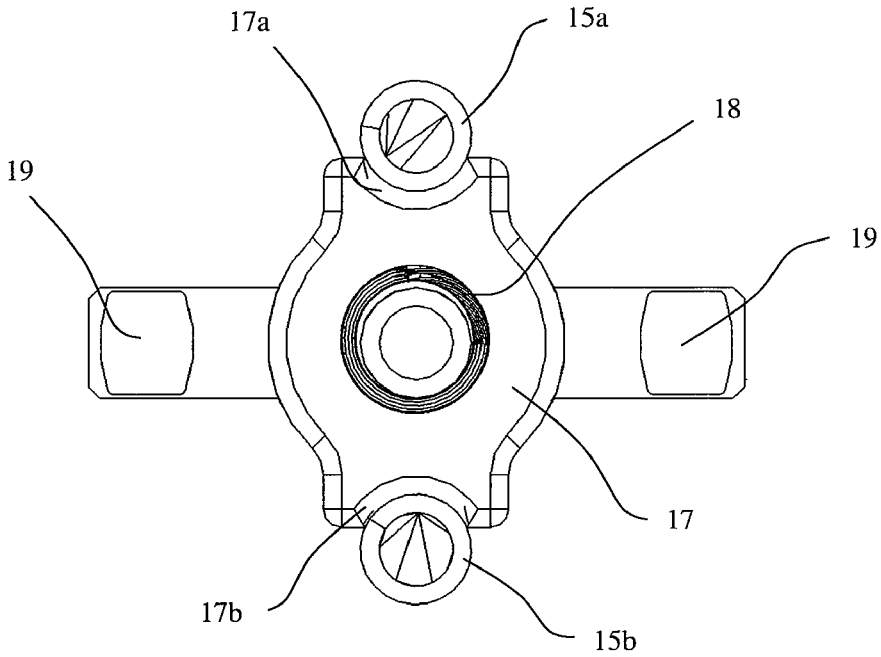

FIGS. 3*a* and 3*b* depict the contact block plunger 17, upper guide rail 15*a* and the lower guide rail 15*b* in isolation, so that their interaction may be more clearly seen. FIG. 3*a* shows that the movement of the contact block plunger 17 can only be in an axial direction, i.e. along the length of the guide rails 15*a*, 15*b* and therefore along the length of the supporting structure 12 shown in FIG. 2*b*. FIG. 3*b* shows that the cooperation between the channels 17*a* and 17*b* and guide rails 15*a* and 15*b* is such that the contact block plunger is restricted to movement along the length of the guide rails 15*a*, 15*b*. Because the guide rails 15*a*, 15*b* restrict the directions in which the contact block plunger 17 can move, accurate alignment of the bridging contacts 19 with the fixed contacts 14 is ensured.

It can be seen from FIGS. 3*a* and 3*b* that the helical spring 18 which biases the contact block plunger 17 to a default position is attached to (and pushes against or pulls) an end of the contact block plunger 17. This is in contrast with the prior art contact block. In the prior art contact block the helical spring biasing the plunger to a default position lies alongside the contact block plunger and pushes against a lip which extends from the contact block. According to a contact block in accordance with an embodiment of the present invention, since the helical spring 18 pushes against an end of the contact block plunger 17, even if the helical spring 18 undulates or becomes 'wavy' under compression it will not push against the contact block plunger 17 and thereby inhibit this movement. Even if the helical spring 18 does become undulated during compression, it cannot push the contact block plunger in any direction other than along the length of the supporting structure 12 due to the presence of the guide rails 15*a*, 15*b* and the channels 17*a*, 17*b* provided in the contact block plunger 17. Thus, in comparison with the prior art contact block, the movement of the contact block plunger 17 of the contact block 10 according to an embodiment of the present invention is more reliable, more consistent and less susceptible to wear and tear due to friction. The movement of the contact plunger is also more likely to reliably and consistently bring the bridging contacts 19 into and out of electrical connection with the fixed pairs of contacts 14.

In FIGS. 2 and 3 it can be seen that the guide rails 15*a*, 15*b* are substantially cylindrical in shape. The channels 17*a*, 17*b* of the contact block plunger have a corresponding open ended semi-circular cross section for receiving the cylindrical guide rails 15*a*, 15*b*. These particular arrangements are not essential. For example, the contact block plunger 17 could, instead of being provided with channels, be provided with one or more protrusions which are received in guide channels which extend along the length of the supporting structure 12. Similarly, on one side of the contact block plunger 17 could be provided elongate protrusions co-operable with a guide channel, whereas on the other (diametrically opposed) side of the contact block plunger 17 maybe an elongate channel co-operable with a guide rail. The guide channels/rails, and the channels/protrusions provided in the contact block plunger 17, do not need to be circular or semi-circular in cross section. Any suitable shape may be employed, so long as movement of the contact block plunger 17 can be restricted to a single direction, for example along the length of the contact block. It will also be appreciated that, in some circumstances, only a single guide rail/channel may be required to co-operate with a single channel or protrusion on the contact block plunger. Instead of having a second, diametrically opposed, channel or protrusion, the contact block plunger could slide across a supporting surface. In short, the contact block maybe provided with any suitable guide co-operable with a guide of a contact block plunger. Similarly, the contact block plunger maybe provided with any suitable guide co-operable with a guide of a contact block.

The contact block plunger 17 may be formed from any suitable material, for example plastic or metal. Similarly, the guide rails, 15*a*, 15*b* can also be formed from any suitable material, such as for example plastics or metals. The support structure 12 and casing 13 may also be formed from any suitable material, such as for example plastics or metals.

Figure 4A:
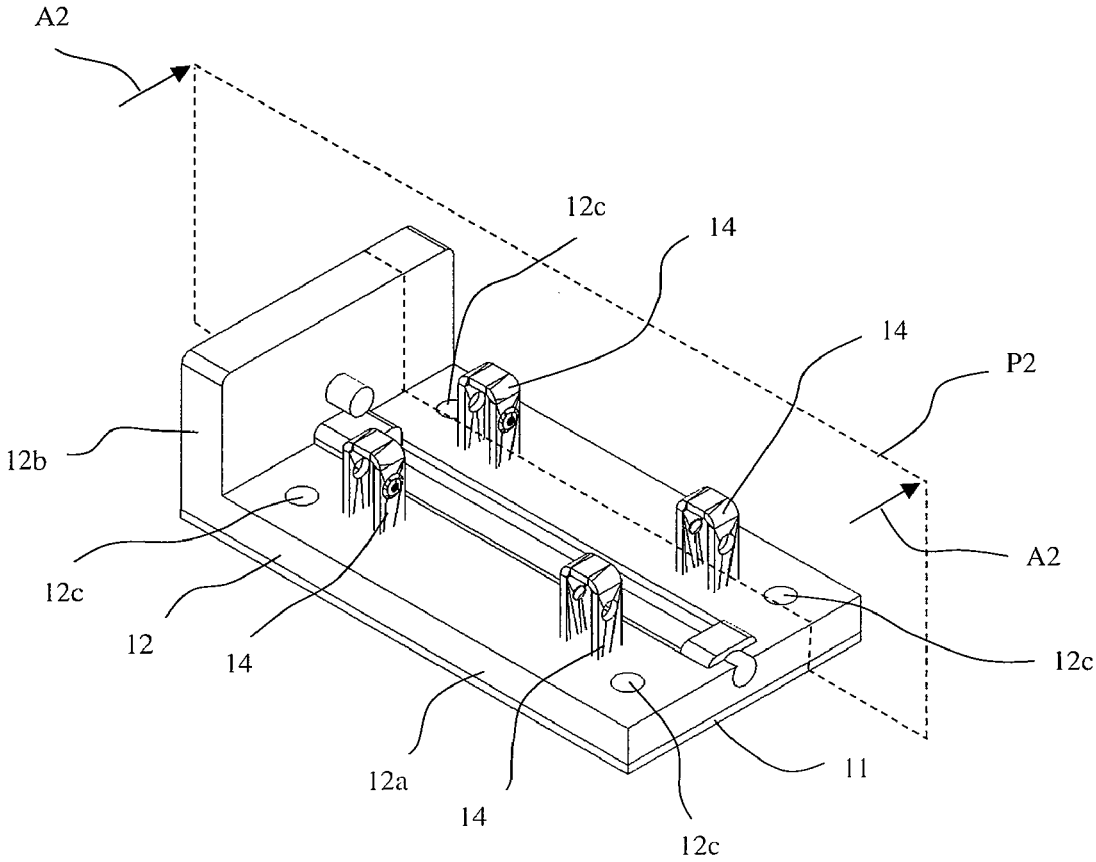
FIGS. 4*a* and 4*b* depict the contact block of FIGS. 2*a* and 2*b*, but highlighting another aspect of the present invention.
Figure 4B:
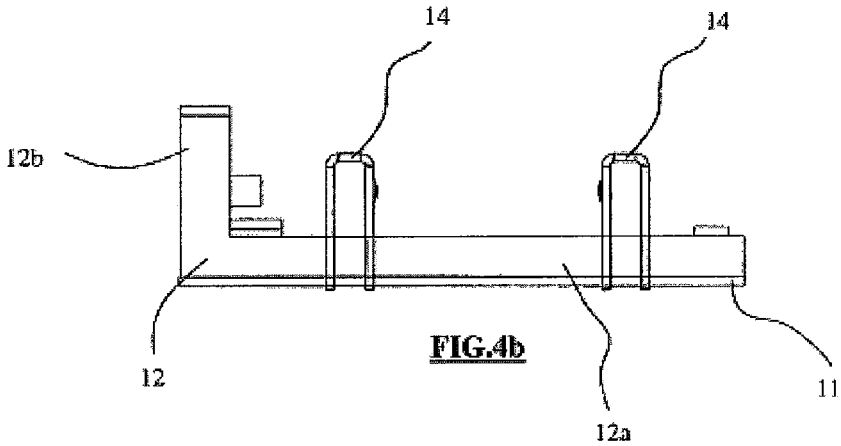

FIG. 4*a* shows a simplified view of FIG. 2*b*, where the contact block plunger 17 and guide rails 15*a*, 15*b* have been removed for clarity. FIG. 4*a* therefore illustrates the printed circuit board 11, on which is mounted the supporting structure 12. The fixed contacts 14 are shown attached to the printed circuit board 11 and extending through the planar region 12*a* on the supporting structure 12. FIG. 4*b* illustrates a cross sectional view of FIG. 4*a* taken in the plane P2 and in the direction of arrows A2 in FIG. 4*a*. It can be seen in FIG. 4*b* that a lower part of the contacts 14 extends through the planar region 12*a* of the supporting structure. The supporting structure 12 fixes the fixed contacts 14 in position and, thereby reduces or eliminates the possibility of these contacts 14 becoming loose during use of the contact block. At the same time, the supporting structure 12 serves to isolate the inner workings of the contact block from the printed circuit board 11. The supporting structure 12 prevents dust, moisture etc.

from coming into contact with the printed circuit board 11, which may otherwise cause the printed circuit board to malfunction. Such a supporting structure 12 is not used in prior art contact blocks. This means that prior art contact blocks are susceptible to having their fixed contacts moved after repeated use, and also their printed circuit boards damaged due to the ingress of dirt, moisture etc.

Figure 5:
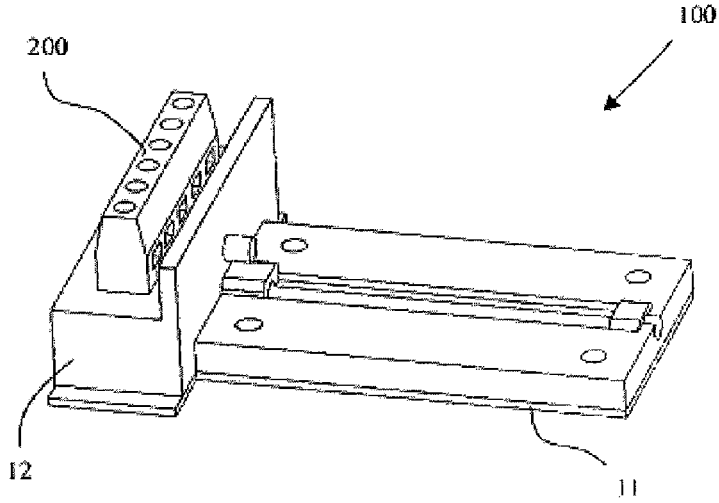
FIG. 5 depicts a contact block provided with an integral terminal block or terminal block connector.

FIG. 5 shows a contact block 100 similar to that shown in FIG. 4*a*, but with the fixed contacts 14 removed for clarity. Features which appear in the contact block of FIG. 4*a* are thus given the same reference numerals in FIG. 5. In accordance with an embodiment of the present invention, the contact block 100 is also provided with an integral terminal block 200 (or, for example, a terminal block connector). The terminal block 200 is an integral part of the support structure 12 described in more detail above. The printed circuit board 11 may be brought into electrical connection with the terminal block 200 via electrical pathways (e.g. wires, conductive channels or the like), which are not shown in the Figure. The pathways may extend through the support layer 12. The contact block 100 may have any of the features of the contact block described in relation to earlier Figures.

The contact block 100 may be connected to other apparatus (for example a power supply and/or kinetic machinery) via the terminal block 200. If wires connecting the terminal block 200 to other apparatus are pulled, they may be pulled out of the terminal block 200. However, since the terminal block 200 is formed integrally with (and therefore supported by) the support layer 12 of the contact block 100, it is unlikely that the terminal block will be removed from the contact block 100, or that the printed circuit board 11 will become damaged if the wires are pulled.

In FIGS. 2, 3 and 4, the contact block has been described as being provided with a contact block plunger. Although it is likely that a contact block would be supplied with a contact block plunger, it is not essential. The contact block and the contact block plunger could be made and sold separately, for example.

It will be appreciated that the above embodiments have been described by way of example only. The skilled person will appreciate that various modifications may be made to these and indeed other embodiments without departing from the scope of the invention, which is defined by the claims that follow.

What is claimed is:

1. A contact block for a safety switch, the contact block comprising:

a support structure;

a fixed pair of electrical contacts fixed in position on the support structure; and a contact block plunger provided with a bridging contact, the bridging contact extending through the contact block plunger, from one side to another, and protruding from the sides of the contact block plunger, the contact block plunger being moveable in-between the fixed pair of electrical contacts to move the bridging contacts into and out of contact with the fixed pair of electrical contacts, and a contact block guide extending along the support structure and between the pair of fixed electrical contacts; the contact block guide further defined as a guide rail and the guide rail is substantially cylindrical and the contact block plunger being co-operable with the contact block guide such that the contact block plunger is restricted to movement along the contact block guide.

2. The contact block as claimed in claim 1, wherein the contact block guide is spaced apart from the support structure, the contact block plunger being located between the guide and the support structure.

3. The contact block as claimed in claim 2, wherein the support structure is provided with an upstanding lip, extending in a direction substantially perpendicularly away from the support structure, the contact block guide being attached to and extending away from the upstanding lip.

4. The contact block as claimed in claim 2, further comprising a casing for encasing internal workings of the contact block, the contact block guide being provided on an inner surface of the casing.

5. The contact block as claimed in claim 1, wherein the contact block plunger is provided with a channel co-operable with the contact block guide.

6. The contact block as claimed in claim 1, wherein the contact block plunger is provided with a channel running along a length of the contact block plunger, the channel being slidably co-operable with and the rail of the contact block guide.

7. The contact block as claimed in claim 1, further comprising a second contact block guide.

8. The contact block as claimed in claim 7, wherein the second contact block guide is one of located on the support structure or located in a recess provided in the support structure.

9. The contact block as claimed in claim 7, wherein the second contact block guide is one of a second guide rail or a channel.

10. The contact block as claimed in claim 9, wherein the second contact block guide is a second guide rail and the second guide rail is substantially cylindrical.

11. The contact block as claimed in claim 9, wherein the second contact block guide is a second guide rail and the contact block plunger is provided with a channel co-operable with the second guide rail.

12. The contact block as claimed in claim 9, wherein the contact block plunger is provided with an elongate protrusion running along the length of the contact block plunger and the second contact block guide is a channel and the elongate protrusion of the contact block plunger is co-operable with the channel of the second contact block guide.

13. The contact block as claimed in claim 1, wherein a biasing element is provided on an end of the contact block plunger, and extending away from the contact block plunger.

14. The contact block as claimed in claim 13, wherein the biasing element is a spring.

15. A contact block for a safety switch, the contact block comprising:

a circuit board;

a fixed pair of electrical contacts fixed in position and connected to the circuit board;

a support structure which extends across the circuit board, the fixed pair of electrical contacts extending from the circuit board and through the support structure; and one of a terminal block or a terminal block connector formed integrally with the support structure.

16. The contact block as claimed in claim 15, wherein the one of the terminal block or terminal block connector is in electrical connection with the circuit board.

17. The contact block as claimed in claim 15, wherein the circuit board is substantially planar.

18. The contact block as claimed in claim 17, wherein the support structure comprises a substantially planar region attached to the substantially planar circuit board.

19. The contact block as claimed in claim 18, wherein the fixed pair of electrical contacts extends through the substantially planar region of the support structure.

20. The contact block as claimed in claim 15, wherein the contact block further comprises a contact block plunger.

21. The contact block as claimed in claim 20, wherein the contact block plunger is provided with a bridging contact that extends through the contact block plunger, from one side to another, and protrudes from the sides of the contact block plunger.

22. The contact block as claimed in claim 21, wherein the contact block plunger is moveable in-between the fixed pair of electrical contacts to move the bridging contact into and out of contact with the fixed pair of electrical contacts.

* * * * *